US009013518B2

(12) United States Patent
Park et al.

(10) Patent No.: US 9,013,518 B2
(45) Date of Patent: Apr. 21, 2015

(54) IMAGE DISPLAY DEVICE AND DRIVING METHOD WITH SELECTIVE BLACK DATA INSERTION

(75) Inventors: Moon-Chul Park, Yongin (KR); Mitsuru Fujii, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 302 days.

(21) Appl. No.: 13/531,463

(22) Filed: Jun. 22, 2012

(65) Prior Publication Data

US 2013/0257913 A1 Oct. 3, 2013

(30) Foreign Application Priority Data

Apr. 2, 2012 (KR) ..... 10-2012-0033883

(51) Int. Cl.
*G09G 3/20* (2006.01)

(52) U.S. Cl.
CPC ..... *G09G 3/2077* (2013.01)

(58) Field of Classification Search
CPC . G09G 3/2044; G09G 3/2048; G09G 3/2051; G09G 3/2055; G09G 3/2077; G09G 2310/061; G09G 2310/062; G09G 2310/063; G09G 2310/065
USPC ..... 345/1.1–111, 156–184, 204–215, 345/690–699
See application file for complete search history.

(56) References Cited

U.S. PATENT DOCUMENTS

| | | | | |
|---|---|---|---|---|
| 8,013,829 | B2 * | 9/2011 | Chen et al. | 345/100 |
| 8,547,418 | B2 * | 10/2013 | Hong | 348/43 |
| 8,749,622 | B2 * | 6/2014 | Tseng et al. | 348/51 |
| 2006/0006797 | A1 * | 1/2006 | Ito et al. | 313/506 |
| 2006/0220572 | A1 * | 10/2006 | Seki | 315/100 |
| 2008/0204433 | A1 * | 8/2008 | Chen et al. | 345/204 |
| 2009/0278777 | A1 * | 11/2009 | Wang et al. | 345/89 |
| 2012/0013707 | A1 * | 1/2012 | Hong | 348/43 |
| 2012/0120067 | A1 * | 5/2012 | Kim et al. | 345/419 |

FOREIGN PATENT DOCUMENTS

| | | | |
|---|---|---|---|
| KR | 10-0489445 | B1 | 5/2005 |
| KR | 10-2006-0056788 | A | 5/2006 |
| KR | 10-2007-0059240 | A | 6/2007 |
| KR | 10-2011-0118001 | A | 10/2011 |

* cited by examiner

*Primary Examiner* — Gene W Lee
(74) *Attorney, Agent, or Firm* — Christie, Parker & Hale, LLP

(57) ABSTRACT

A driving method for an image display device including sub-pixels arranged in rows and columns, the driving method including: receiving first data corresponding to one frame; dividing the one frame into fields; generating second data from the first data for each of the fields; and supplying the second data to the sub-pixels. Where, the second data is generated by selectively inserting black data in portions of the first data.

16 Claims, 5 Drawing Sheets

IMAGE DISPLAY DEVICE AND DRIVING METHOD WITH SELECTIVE BLACK DATA INSERTION

CROSS-REFERENCE TO RELATED APPLICATION

This application claims priority to and the benefit of Korean Patent Application No. 10-2012-0033883, filed on Apr. 2, 2012, in the Korean Intellectual Property Office, the entire content of which is incorporated herein by reference.

BACKGROUND

1. Field

Aspects of the present invention relate to an image display device and a driving method thereof, and more particularly, to an image display device capable of improving a data processing speed, and a driving method thereof.

2. Description of the Related Art

Recently, various image display devices capable of reducing weight and volume, which are disadvantages of a cathode ray tube, have been developed. As examples of these image display devices there are: a liquid crystal display (LCD), a field emission display (FED), a plasma display panel (PDP), an organic light emitting display device (OLED), and the like.

In these image display devices, a plurality of pixels are configured using red sub-pixels, green-sub pixels, and blue sub-pixels to display various color images.

SUMMARY

An aspect of embodiments of the present invention is to provide an image display device capable of improving a data processing speed, and a driving method thereof.

According to an exemplary embodiment of the present invention, there is provided a driving method for an image display device including sub-pixels arranged in rows and columns, the driving method including: receiving first data corresponding to one frame; dividing the one frame into a plurality of fields; generating second data from the first data for each of the plurality of fields; and supplying the second data to the sub-pixels, wherein the second data is generated by selectively inserting black data in portions of the first data.

The sub-pixels may have a hexagonal shape.

The one frame may be divided into first and second fields, when generating the second data, the black data may be inserted to be supplied to sub-pixels of a third row of three rows adjacent to each other during the first field, and when generating the second data, the black data may be inserted to be supplied to sub-pixels of a first row of the three rows during the second field.

The first data may include a plurality of line data each supplied to two rows, the black data may be inserted into even numbered line data of the plurality of line data to generate the second data of the first field, and the black data may be inserted in a mosaic type into the plurality of line data to generate the second data of the second field.

The one frame may be divided into first and second fields, when generating the second data, the black data may be inserted to be supplied to sub-pixels positioned at even numbered columns of a first row of three rows adjacent to each other and odd numbered columns of a third row thereof during the first field, and when generating the second data, the black data may be inserted to be supplied to sub-pixels positioned at odd numbered columns of the first row of the three rows and even numbered columns of the third row thereof during the second field.

The first data may include a plurality of line data each supplied to two rows, the black data may be inserted into k-th (k meaning 3, 7, 11, . . . ) positions of odd numbered line data of the plurality of line data and be inserted into the remaining positions other than the k-th positions of even numbered line data thereof to generate the second data of the first field, and the black data may be inserted into j-th (j meaning 1, 5, 9, . . . ) positions of the odd numbered line data of the plurality of line data and be inserted into the remaining positions other than j-th positions of the even numbered line data thereof to generate the second data of the second field.

The one frame may be divided into first, second, and third fields, when generating the second data, the black data may be inserted to be supplied to sub-pixels of a third row of three rows adjacent to each other during the first and second fields, and when generating the second data, the black data may be inserted to be supplied to sub-pixels of a first row of the three rows during the third field.

According to another exemplary embodiment of the present invention, there is provided a driving method for an image display device including sub-pixels arranged in rows and columns, the driving method including: receiving first data corresponding to one frame; dividing the one frame into a plurality of fields; generating second data from the first data according to the plurality of fields; and supplying the second data to the sub-pixels, wherein the second data is generated by selectively inserting black data in portions of the first data so that brightnesses of first and third rows of three rows adjacent to each other are lowered.

Sub-pixels of a central row of the three rows may maintain an original brightness.

According to still another exemplary embodiment of the present invention, there is provided an image display device including: sub-pixels arranged in rows and columns; scan lines each coupled to sub-pixels positioned at two rows; a scan driver configured to drive the scan lines; a data driver configured to generate data signals according to second data; and a data processor configured to receive first data from the outside, and to supply the second data corresponding to the first data to be supplied to a plurality of fields that are included in one frame, wherein the data processor is configured to generate the second data by inserting black data in the first data.

The black data may be inserted so that brightnesses of sub-pixels positioned at first and third rows of three rows adjacent to each other are lowered during the one frame.

The sub-pixels may have a hexagonal shape.

The data processor may include: a frame memory configured to store the first data by one frame therein; and a data distributor configured to generate the second data according to the first data stored in the frame memory.

The one frame may be divided into first and second fields, and the data distributor may be configured to insert the black data to generate the second data to be supplied to sub-pixels of a third row of three rows adjacent to each other during the first field and to insert the black data to generate the second data to be supplied to sub-pixels of a first row of the three rows during the second field.

The one frame may be divided into first and second fields, and the data distributor may be configured to insert the black data to generate the second data to be supplied to sub-pixels positioned at even numbered columns of a first row of three rows adjacent to each other and odd numbered columns of a third row thereof during the first field and to insert the black data to generate the second data to be supplied to sub-pixels positioned at odd numbered columns of the first row of the three rows and even numbered columns of the third row thereof during the second field.

The one frame may be divided into first, second, and third fields, and the data distributor may be configured to insert the black data to generate the second data to be supplied to sub-pixels of a third row of three rows adjacent to each other during the first and second fields, and to insert the black data to generate the second data to be supplied to sub-pixels of a first row of the three rows during the third field.

BRIEF DESCRIPTION OF THE DRAWINGS

The accompanying drawings, together with the specification, illustrate exemplary embodiments of the present invention, and, together with the description, serve to explain aspects of embodiments of the present invention.

DETAILED DESCRIPTION

Figure 1:
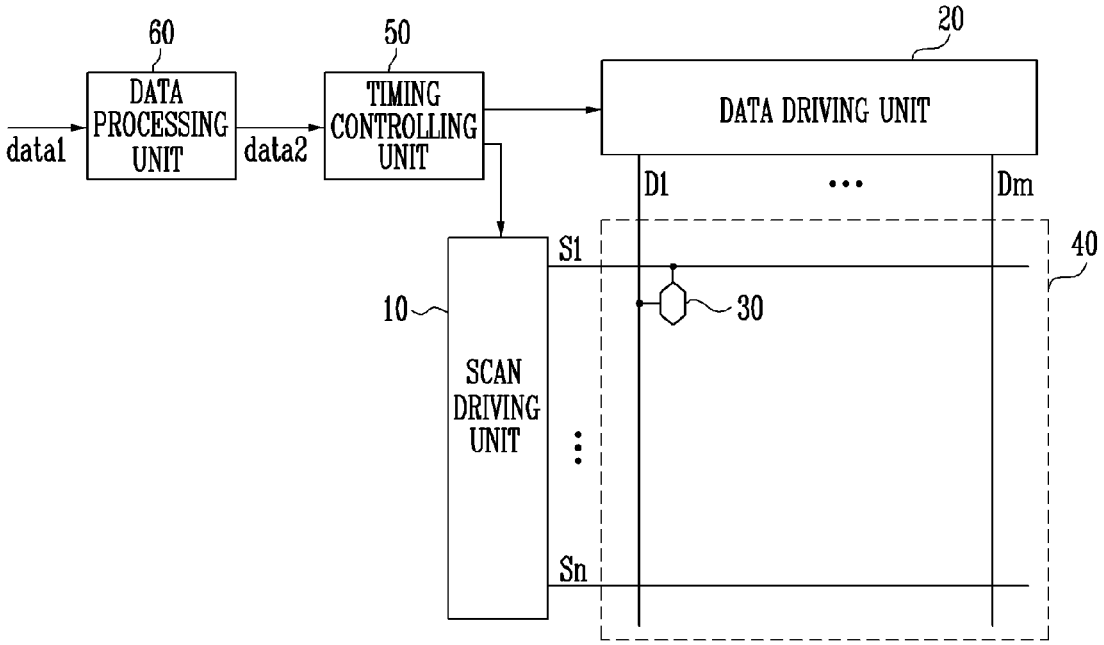
FIG. 1 is a diagram showing an image display device according to an exemplary embodiment of the present invention.

The red sub-pixels, the green sub-pixels, and the blue sub-pixels of a display device may be arranged in various types, for example, in a stripe type. In the stripe type, the same colored sub-pixels are arranged in a row unit. When the sub-pixels are arranged in the stripe type, a vertical stripe pattern may be viewed in certain images.

Additionally, an image display device may have the sub-pixels arranged in a hexagonal type. In the case in which the sub-pixels are arranged in the hexagonal type, red sub-pixels, green sub-pixels, and blue sub-pixels are disposed adjacent to each other in two rows to configure a single pixel, thereby making it possible to display an image having a high resolution.

However, in the case in which the sub-pixels are formed in the hexagonal type, a letter, or the like, may be jaggedly displayed. In order to address this problem, an algorithm of lowering the brightnesses of sub-pixels in first and third horizontal lines of three horizontal lines adjacent to each other, and maintaining the brightnesses of sub-pixels in a central horizontal line thereof to improve readability has been applied.

One way to implement the above algorithm includes the following: the data is gamma-processed, the algorithm may then be applied to the gamma-processed data, the data to which the algorithm is applied may then be de-gamma-processed, and the de-gamma-processed data may then be supplied to the image display device. In this case, as a data processing speed increases, circuits for applying gamma and de-gamma may be additionally inserted.

Hereinafter, certain exemplary embodiments according to the present invention will be described with reference to the accompanying drawings. Here, when a first element is described as being coupled (e.g., electrically coupled or connected) to a second element, the first element may be directly coupled to the second element or may be indirectly coupled to the second element via one or more intervening elements. Further, some of the elements that may not be essential to the complete understanding of the invention may be omitted for clarity. Also, like reference numerals refer to like elements throughout.

Hereinafter, exemplary embodiments of the present invention will be described in detail with reference to FIGS. 1 through 9 so that those skilled in the art to which the present invention pertains may easily practice the present invention.

FIG. 1 is a diagram showing an image display device according to an exemplary embodiment of the present invention.

Referring to FIG. 1, the image display device according to the present embodiment may be configured to include a pixel unit 40 including sub-pixels 30 positioned at regions defined by scan lines S1 to Sn and data lines D1 to Dm, a scan driving unit (scan driver) 10 driving the scan lines S1 to Sn, a data driving unit (data driver) 20 driving the data lines D1 to Dm, a timing controlling unit (timing controller) 50 controlling the scan driving unit 10 and data driving unit 20, and a data processing unit (data processor) 60 rearranging first data "data1" supplied from the outside to generate second data "data2."

Figure 3:
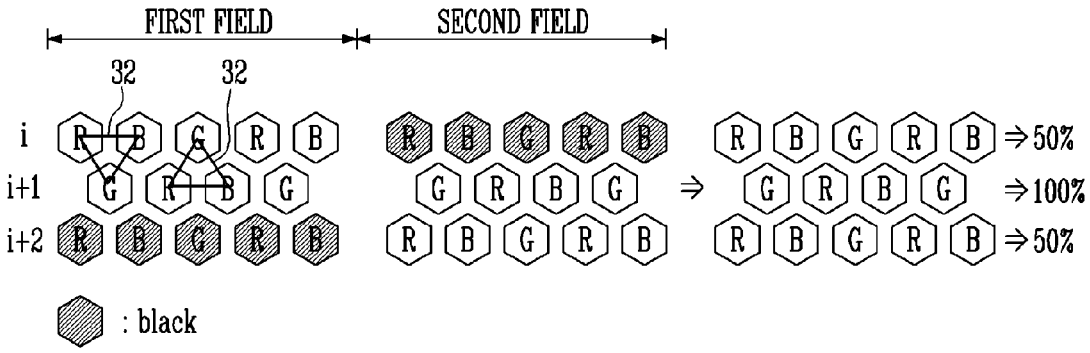
FIG. 3 is a diagram showing an example of an operation process of a data distributor shown in FIG. 2.

As shown in FIG. 3, the sub-pixels 30 are formed in a hexagonal type (e.g., the sub-pixels may have a hexagonal shape). Here, the sub-pixels 30 positioned at two horizontal lines (or rows) form a single pixel 32. The sub-pixels 30 are selected when they are supplied with scan signals, thereby storing a voltage corresponding to data signals therein and emit light having a brightness corresponding to the stored voltage.

The scan driving unit 10 supplies the scan signals to the scan line S1 to Sn. Here, each of the scan lines S1 to Sn is coupled to corresponding sub-pixels 30 to supply the scan signals to the corresponding sub-pixels 30. The scan driving unit 10 may supply the scan signals in various types according to a driving method. For example, in the case in which a plurality of fields are included in one frame, the scan driving unit 10 may sequentially supply the scan signals to the scan lines S1 to Sn in each field period.

The data driving unit 20 supplies the data signals to the data lines D1 to Dm so as to be synchronized with the scanning signals. In this case, the data signals are supplied to the sub-pixels 30 selected by the scanning signals.

In the present embodiment, the timing controlling unit 50 supplies control signals (not shown) for controlling the scan driving unit 10 and the data driving unit 20. In addition, the timing controlling unit 50 may transfer the second data "data2" supplied from the data processing unit 60 to the data driving unit 20. Here, the timing controlling unit 50 supplies the second data "data2" so as to correspond to each of the plurality of fields included in one frame.

In embodiments of the present invention, the data processing unit 60 rearranges the first data "data1" to generate the second data "data2." Here, the data processing unit 60 may generate the second data "data2" so as to supply the first data "data1" of one frame to the plurality of fields. In addition, the data processing unit 60 may generate the second data "data2"

(e.g., to improve readability) corresponding to the hexagonal type sub-pixels 30. A detailed description thereof will be provided below.

Figure 2:
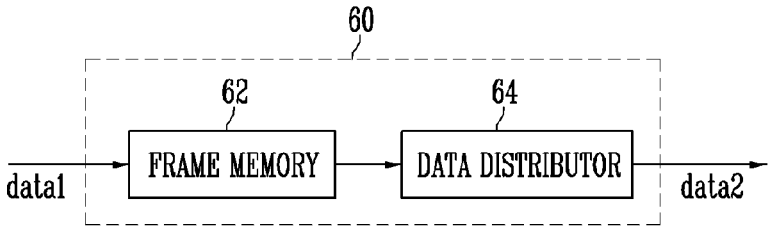
FIG. 2 is a diagram showing an example of a data processing unit shown in FIG. 1.

FIG. 2 is a diagram showing an example of a data processing unit shown in FIG. 1.

Referring to FIG. 2, the data processing unit 60 according to an exemplary embodiment of the present invention includes a frame memory 62 and a data distributor 64. The frame memory 62 stores the first data "data1" by one frame therein. The data distributor 64 redistributes the first data "data1" stored in the frame memory 62 to generate the second data "data2." For example, the data distributor 64 may lower the brightness of sub-pixels 30 in first and third horizontal lines of three horizontal lines adjacent to each other and may maintain the brightness of sub-pixels 30 in a central horizontal line thereof to improve readability. To this end, the data distributor 64 may insert black data into the first data "data1" to generate the second data "data2."

FIG. 3 a diagram showing an example of an operation process of a data distributor shown in FIG. 2. In FIG. 3, it is assumed that one frame (or frame period) is divided into a first field and a second field (or field period) for convenience of explanation.

Referring to FIG. 3, during the first field period, the data distributor 64 rearranges the first data "data1" to generate the second data "data2" so that data having a set (or predetermined) brightness is supplied to sub-pixels positioned at i-th and i+1-th horizontal lines (i indicates a natural number) and black data is supplied to sub-pixels positioned at an i+2-th horizontal line. In addition, during the second field period, the data distributor 64 rearranges the first data "data1" to generate the second data "data2" so that the black data is supplied to the sub-pixels 30 positioned at the i-th horizontal line and the brightness data is supplied to the sub-pixels 30 positioned at the i+1-th and i+2-th horizontal lines.

As the embodiment in FIG. 3 illustrates, during one frame period, which corresponds to the combination of the first and second fields, the i-th and i+2-th horizontal lines implement a brightness of 50% of the brightness data, and the i+1-th horizontal line implements a brightness of 100% of the brightness data. In other words, during one frame period, the first and third horizontal lines of the adjacent three horizontal lines are set to have a brightness of 50% of the brightness data, and the central horizontal line thereof is set to have a brightness of 100% of the brightness data, thereby making it possible to display an image having improved readability.

Thus, according to aspects of exemplary embodiments of the present invention, since the brightness of the horizontal lines may be controlled by rearranging the data and inserting the black data, a data processing speed may be improved. In addition, according to the aspects of embodiments of the present invention, since a gamma-processing process and a de-gamma-processing process are not included, a circuit may be simply configured.

Additionally, the operation in which a frame is divided into the plurality of fields and the black data is inserted in order to control the brightness of the horizontal lines in at least one field may be implemented by various methods. For example, the data distributor 64 may redistribute data as shown in FIG. 4.

Figure 4:
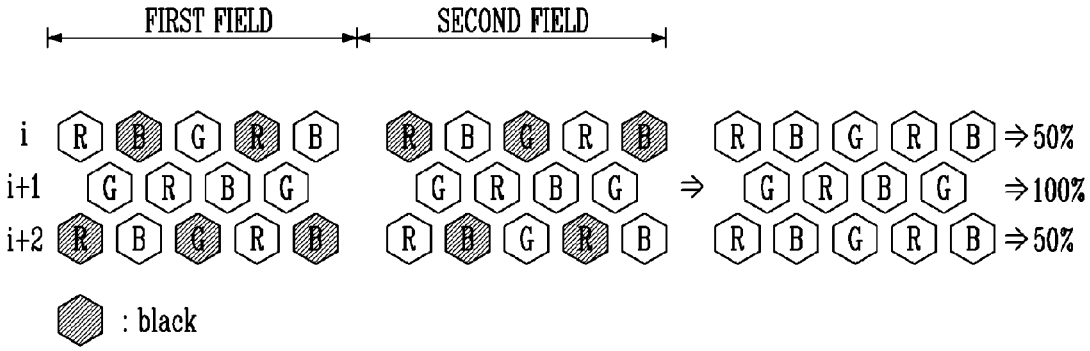
FIG. 4 is a diagram showing another example of an operation process of the data distributor shown in FIG. 2.

FIG. 4 is a diagram showing another example of an operation process of the data distributor shown in FIG. 2. In FIG. 4, it is assumed that one frame is divided into a first field and a second field, for convenience of explanation.

Referring to FIG. 4, during a first field period, the data distributor 64 supplies brightness data to sub-pixels 30 positioned at odd numbered columns of an i-th horizontal line (e.g., row) and supplies black data to sub-pixels 30 positioned at even numbered columns thereof. In addition, during the first field period, the data distributor 64 supplies black data to sub-pixels 30 positioned at odd numbered columns of an i+2-th horizontal line and supplies the brightness data to sub-pixels 30 positioned at even numbered columns thereof. Further, the data distributor 64 supplies the brightness data to sub-pixels 30 positioned at an i+1-th horizontal line.

During a second field period, the data distributor 64 supplies the black data to the sub-pixels 30 positioned at the odd numbered columns of the i-th horizontal line and supplies the brightness data to the sub-pixels 30 positioned at the even numbered columns thereof. In addition, during the second field period, the data distributor 64 supplies the brightness data to the sub-pixels 30 positioned at the odd numbered columns of the i+2-th horizontal line and supplies the black data to the sub-pixels 30 positioned at the even numbered columns thereof. Further, the data distributor 64 supplies the brightness data to the sub-pixels 30 positioned at the i+1-th horizontal line.

In this case, during one frame period corresponding to the combination of the first and second fields, a brightness of 50% of the brightness data is implemented at the i-th and i+2-th horizontal lines, and a brightness of 100% of the brightness data is implemented at the i+1-th horizontal line.

As described above, the data distributor 64 according to an exemplary embodiment of the present invention generates the second data "data2" using the first data "data1" so that the readability, or the like, is improved, and supplies the generated second data "data2" to the timing controlling unit 50. In this case, the timing controlling unit 50 may supply the second data "data2", corresponding to the first and second fields of the frame, thereby making it possible to display an image having an improved quality.

The data distributor 64 may rearrange the data in various forms in order to implement the images of FIGS. 3 and 4.

Figure 5:
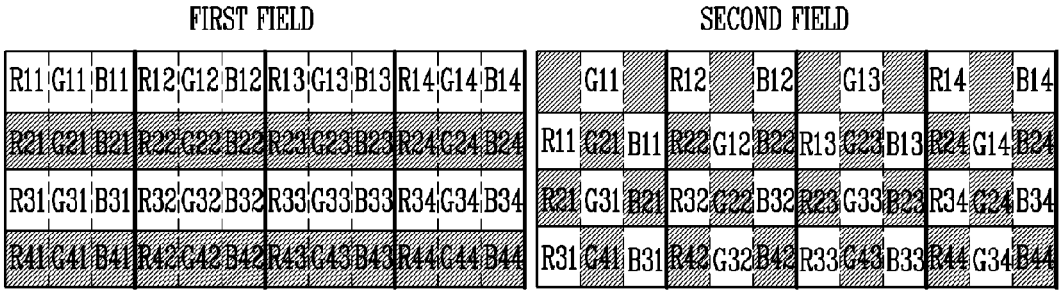
FIG. 5 is a diagram showing a data rearranging process for implementing an image of FIG. 3.

FIG. 5 is a diagram showing a data rearranging process for implementing an image of FIG. 3.

Referring to FIG. 5, the data distributor 64 rearranges line data during first and second fields. Here, the line data means data supplied to two horizontal lines of the pixel unit 40.

In the present embodiment, the data distributor 64 inserts original brightness data into odd numbered data and inserts black data into even numbered data to generate the second data "data2" of the first field. In addition, the data distributor 64 may insert the black data in a mosaic type into the odd and even numbered line data to generate the second data "data2" of the second field.

The second data "data2" generated in the data distributor 64 may be supplied to the data driving unit 20 through the timing controlling unit 50. The data driving unit 20 may generate the data signals using the second data "data2" and may supply the generated data signals to the data lines D1 to Dm so as to be synchronized with the scanning signals.

Figure 6:
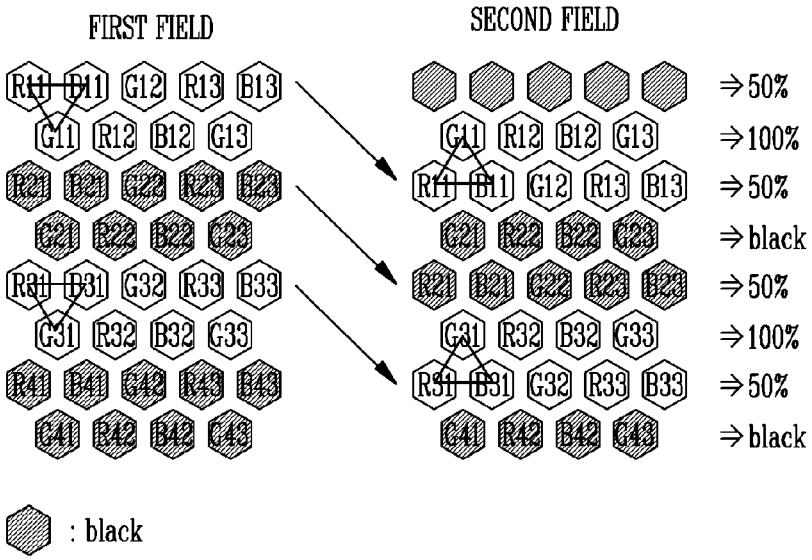
FIG. 6 is a diagram showing data distributed to horizontal lines by data of FIG. 5.

As shown in FIG. 6, during the first and second field periods, the sub-pixels 30 emit light corresponding to the second data "data2." Here, the adjacent three horizontal lines are sequentially set to have, for example, a brightness of 50% of the brightness data, brightness of 100% thereof, and brightness of 50% thereof, thereby making it possible to display a high quality image. Additionally, in the case in which the second data "data2" is generated as shown in FIG. 5, a horizontal line displaying black may be inserted between the adjacent three horizontal lines. When the horizontal line displaying black is inserted between the adjacent three horizontal lines, a more vivid image may be displayed.

Figure 7:
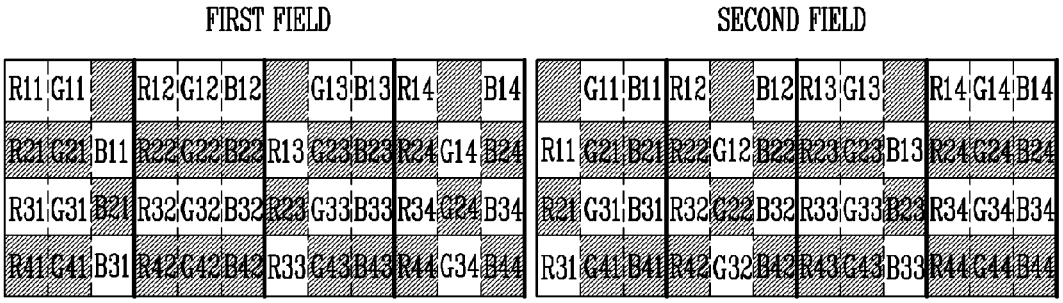
FIG. 7 is a diagram showing a data rearranging process for implementing an image of FIG. 4.

FIG. 7 is a diagram showing a data rearranging process for implementing the image of FIG. 4.

Referring to FIG. 7, the data distributor 64 rearranges line data during first and second fields. Here, the line data means data supplied to two horizontal lines of the pixel unit 40.

The data distributor 64 may insert black data into k-th (k means 3, 7, 11 . . . ) positions of odd numbered line data and may insert the black data into the remaining positions other than the k-th positions of even numbered line data to generate the second data "data2" of the first field. In addition, the data distributor 64 may insert the black data into j-th (j means 1, 5, 9 . . . ) positions of the odd numbered line data and may insert the black data into the remaining positions other than the j-th positions of the even numbered line data to generate the second data "data2" of the second field.

The second data "data2" generated in the data distributor 64 may be supplied to the data driving unit 20 through the timing controlling unit 50. In an embodiment, the data driving unit 20 generates the data signals using the second data "data2" and supplies the generated data signals to the data lines D1 to Dm so as to be synchronized with the scanning signals.

Figure 8:
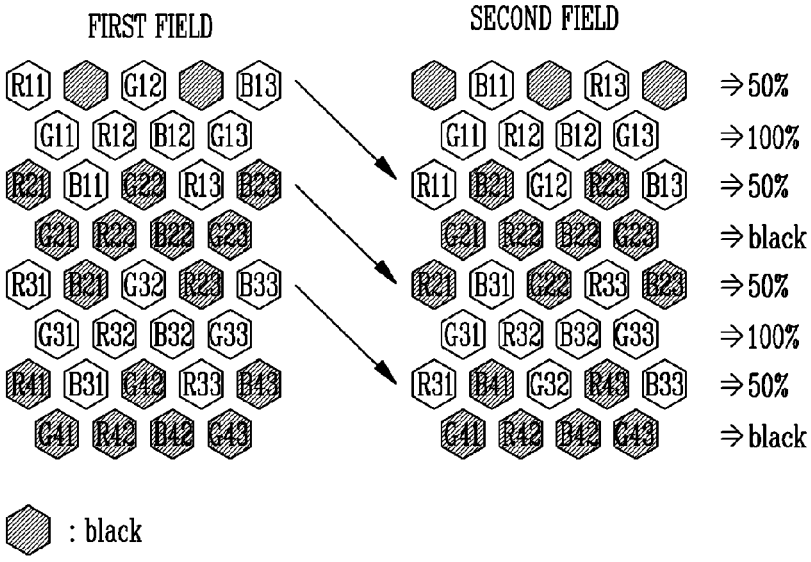
FIG. 8 is a diagram showing data distributed to horizontal lines by data of FIG. 7.

In this case, as shown in FIG. 8, during the first and second field periods, the sub-pixels 30 emit light corresponding to the second data "data2." Here, the adjacent three horizontal lines may be sequentially set to have a brightness of 50% of the brightness data, a brightness of 100% thereof, and a brightness of 50% thereof, thereby making it possible to display a high quality image. Additionally, in the case in which the second data "data2" is generated as shown in FIG. 7, a horizontal line displaying black may be inserted between the adjacent three lines. As described above, when the horizontal line displaying black is inserted between the adjacent three horizontal lines, a more vivid image may be displayed.

Figure 9:
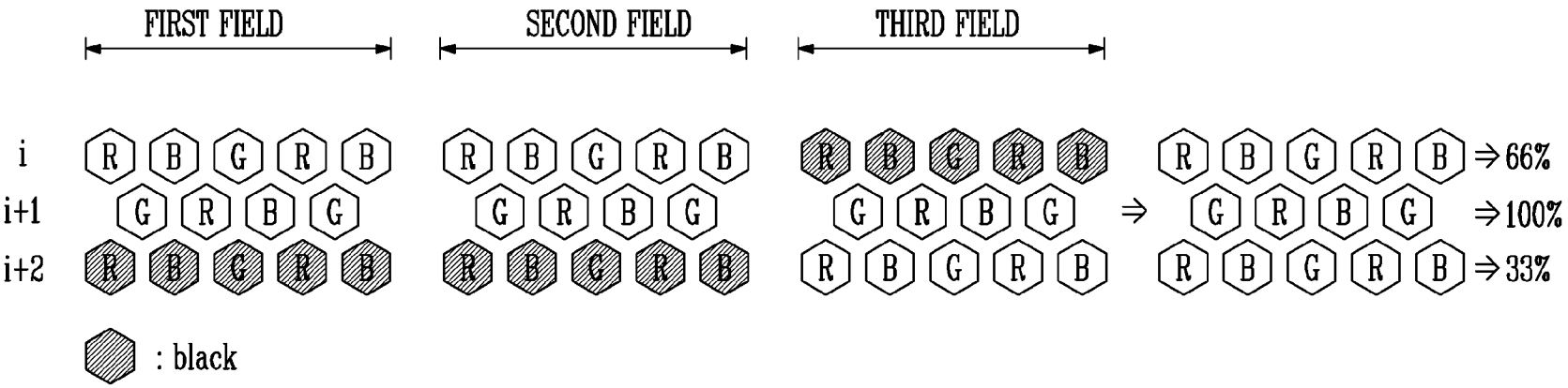
FIG. 9 is a diagram showing another example of an operation process of the data distributor shown in FIG. 2.

FIG. 9 is a diagram showing another example of an operation process of the data dividing unit shown in FIG. 2. In FIG. 9, it is assumed that one framed is divided into three fields.

Referring to FIG. 9, during the first and second field periods, the data distributor 64 rearranges the first data "data1" to generate the second data "data2" so that brightness data is supplied to the i-th and the i+1-th horizontal lines and black data is supplied to the i+2-th horizontal line.

In addition, in the present embodiment, during a third field period, the data distributor 64 rearranges the first data "data1" to generate the second data "data2" so that the i-th horizontal line supplies the black data and the i+1-th and i+2-th horizontal lines supply the brightness data.

In this case, during one frame period corresponding to the combination of the first, second, and third fields, a brightness of 66% of the brightness data is implemented at the i-th horizontal line, a brightness of 100% thereof is implemented at the i+1-th horizontal line, and a brightness of 33% thereof is implemented at the i+2-th horizontal line. As described above, when the central line of the adjacent three horizontal lines is set to have brightness higher than those of the other lines, the readability, or the like, may be improved.

As such, according to aspects of embodiments of the present invention, one frame is divided into a plurality of fields, and black data is selectively supplied to the plurality of fields, thereby making it possible to display an image having various type weights, that is, brightness. In other words, the present invention may be implemented as various embodiments so that the data is supplied to a specific horizontal line in the plurality of fields.

As set forth above, with the image display device and the driving method thereof according to embodiments of the present invention, one frame is divided into a plurality of fields, and black data is inserted into a horizontal line unit in at least one field. In this case, the brightness is controlled in the horizontal line unit by the black data, thereby making it possible to display an image having improved readability. Particularly, according to the present embodiment, the data is changed without performing the gamma-processing and de-gamma-processing, thereby making it possible to minimize a processing speed and a circuit configuration.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A driving method for an image display device comprising sub-pixels arranged in rows and columns, the driving method comprising:

receiving first data corresponding to one frame of a single image;

dividing the one frame of the single image into a plurality of fields;

generating second data from the first data for each of the plurality of fields; and supplying the second data to the sub-pixels, wherein the second data is generated by selectively inserting black data in portions of the first data, and the black data is provided to less than all of the sub-pixel rows.

2. The driving method according to claim 1, wherein the sub-pixels have a hexagonal shape.

3. The driving method according to claim 1, wherein the one frame is divided into first and second fields, when generating the second data, the black data is inserted to be supplied to sub-pixels of a third row of three rows adjacent to each other during the first field, and when generating the second data, the black data is inserted to be supplied to sub-pixels of a first row of the three rows during the second field.

4. The driving method according to claim 3, wherein the first data comprises a plurality of line data each supplied to two rows, the black data is inserted into even numbered line data of the plurality of line data to generate the second data of the first field, and the black data is inserted in a mosaic type into the plurality of line data to generate the second data of the second field.

5. The driving method according to claim 1, wherein the one frame is divided into first and second fields, when generating the second data, the black data is inserted to be supplied to sub-pixels positioned at even numbered columns of a first row of three rows adjacent to each other and odd numbered columns of a third row thereof during the first field, and when generating the second data, the black data is inserted to be supplied to sub-pixels positioned at odd numbered columns of the first row of the three rows and even numbered columns of the third row thereof during the second field.

6. The driving method according to claim 5, wherein the first data comprises a plurality of line data each supplied to two rows, the black data is inserted into k-th (k meaning 3, 7, 11, . . . ) positions of odd numbered line data of the plurality of line data and inserted into the remaining positions other than the k-th positions of even numbered line data thereof to generate the second data of the first field, and the black data is inserted into j-th (j meaning 1, 5, 9, . . . ) positions of the odd numbered line data of the plurality of line data and inserted into the remaining positions other than the j-th positions of the even numbered line data thereof to generate the second data of the second field.

7. The driving method according to claim 1, wherein the one frame is divided into first, second, and third fields, when generating the second data, the black data is inserted be supplied to sub-pixels of a third row of three rows adjacent to each other during the first and second fields, and when generating the second data, the black data is inserted to be supplied to sub-pixels of a first row of the three rows during the third field.

8. A driving method for an image display device comprising sub-pixels arranged in rows and columns, the driving method comprising:

receiving first data corresponding to one frame of a single image;

dividing the one frame of the single image into a plurality of fields;

generating second data from the first data according to the plurality of fields; and supplying the second data to the sub-pixels, wherein the second data is generated by selectively inserting black data in portions of the first data so that brightnesses of first and third rows of three rows adjacent to each other are lowered, and the black data is provided to less than all of the sub-pixel rows.

9. The driving method according to claim 8, wherein sub-pixels of a central row of the three rows maintain an original brightness.

10. An image display device comprising:

sub-pixels arranged in rows and columns;

scan lines each coupled to sub-pixels positioned at two rows;

a scan driver configured to drive the scan lines;

a data driver configured to generate data signals according to second data; and a data processor configured to receive first data corresponding to one frame of a single image from outside, and to generate the second data corresponding to a plurality of fields of the one frame of the single image to be supplied to the sub-pixels for the one frame of the single image, wherein the data processor is configured to generate the second data by selectively inserting black data in the first data, and the black data is provided to less than all of the sub-pixel rows.

11. The image display device according to claim 10, wherein the black data is inserted so that brightnesses of sub-pixels positioned at first and third rows of three rows adjacent to each other are lowered during the one frame.

12. The image display device according to claim 10, wherein the sub-pixels have a hexagonal shape.

13. The image display device according to claim 10, wherein the data processor comprises:

a frame memory configured to store the first data by one frame therein; and a data distributor configured to generate the second data according to the first data stored in the frame memory.

14. The image display device according to claim 13, wherein the one frame is divided into first and second fields, and the data distributor is configured to insert the black data to generate the second data to be supplied to sub-pixels of a third row of three rows adjacent to each other during the first field and to insert the black data to generate the second data to be supplied to sub-pixels of a first row of the three rows during the second field.

15. The image display device according to claim 13, wherein the one frame is divided into first and second fields, and the data distributor is configured to insert the black data to generate the second data to be supplied to sub-pixels positioned at even numbered columns of a first row of three rows adjacent to each other and odd numbered columns of a third row thereof during the first field and to insert the black data to generate the second data to be supplied to sub-pixels positioned at odd numbered columns of the first row of the three rows and even numbered columns of the third row thereof during the second field.

16. The image display device according to claim 13, wherein the one frame is divided into first, second, and third fields, and the data distributor is configured to insert the black data to generate the second data to be supplied to sub-pixels of a third row of three rows adjacent to each other during the first and second fields, and to insert the black data to generate the second data to be supplied to sub-pixels of a first row of the three rows during the third field.

* * * * *